US005842102A

United States Patent [19]

Montfort et al.

[11] Patent Number: 5,842,102

[45] Date of Patent: Nov. 24, 1998

[54] ULTRASONIC ASSIST FOR BLADE CLEANING

[75] Inventors: David B. Montfort, Webster; Nero R. Lindblad, Ontario, both of N.Y.

[73] Assignee: Xerox Corporation, Stamford, Conn.

[21] Appl. No.: 885,432

[22] Filed: Jun. 30, 1997

[51] Int. Cl.[6] ..... G03G 21/00

[52] U.S. Cl. ..... 399/349; 15/256.5; 399/351

[58] Field of Search ..... 399/343, 349, 399/350, 351, 98–101; 15/1.51, 256.5, 256.51, 256.52, 1; 430/125; 134/1

[56] References Cited

U.S. PATENT DOCUMENTS

| | | | |
|---|---|---|---|
| 3,848,993 | 11/1974 | Hasiotis | 399/351 |
| 4,007,982 | 2/1977 | Stange | 399/351 |
| 4,111,545 | 9/1978 | Meltzer | 399/351 |
| 4,111,546 | 9/1978 | Maret | 399/349 |
| 4,518,248 | 5/1985 | Nishikawa | 399/350 X |
| 4,763,168 | 8/1988 | Lindblad | 15/262.52 X |
| 4,794,878 | 1/1989 | Connors et al. | 399/265 |
| 4,875,070 | 10/1989 | Hattori | 399/350 |
| 4,875,081 | 10/1989 | Goffe et al. | 399/343 |

*Primary Examiner*—Arthur T. Grimley
*Assistant Examiner*—Sophia S. Chen
*Attorney, Agent, or Firm*—Tamera L. Fair; Christopher D. Wait

[57] ABSTRACT

A printing machine and apparatus are disclosed that include an ultrasonically assisted cleaning blade to remove toner particles from an imaging surface. An ultrasonic transducer is attached to the cleaning blade to provide vibrational energy to the cleaning blade. The ultrasonic transducer concentrates vibrational energy at the blade tip for enhanced cleaning. A further element of the present invention is the addition of bias to create a strong electrostatic repulsion between the toner particles and the blade tip causing the toner to explode away from the cleaning edge, and to therefore enhance cleaning.

21 Claims, 6 Drawing Sheets

ULTRASONIC ASSIST FOR BLADE CLEANING

BACKGROUND OF THE INVENTION

This invention relates generally to an electrostatographic printer and copier, and more particularly, a ultrasonically assisted cleaning blade.

Ultrasonic devices normally vibrate the back side of a photoreceptor directly under the cleaning nip. This ultrasonic assist method creates disadvantages that include: first, requiring the location of the tip of the ultrasonic device to be directly under the cleaning edge to create an "air bearing" effect to reduce the blade friction, and second, requiring the ultrasonic device to be located inside the belt module. In printers or copiers with small belt modules, the ultrasonic device cannot be located inside the belt module.

The following disclosures may be relevant to various aspects of the present invention and may be briefly summarized as follows:

U.S. Pat. No. 4,704,878 to Connors et al. discloses a single component development system including a housing with a sump containing a supply of toner, an ultrasonic transducer having one end extending into the source of the toner and the other end disposed adjacent a photoreceptor, and a current source electrically connected to the ultrasonic transducer to charge the toner and move the toner from the sump to the photoreceptor.

U.S. Pat. No. 4,111,546 to Maret discloses an electrostatographic reproducing apparatus and process including a system for ultrasonically cleaning residual material from the imaging surface. Ultrasonic vibratory energy is applied to the air space adjacent the imaging surface to excite the air molecules for dislodging the residual material from the imaging surface. Preferably pneumatic cleaning is employed simultaneously with the ultrasonic cleaning. Alternatively, a conventional mechanical cleaning system is augmented by localized vibration of the imaging surface at the cleaning station which are provided from behind the imaging surface.

U.S. Pat. No. 4,007,982 to Stange discloses a cleaning apparatus, electrostatographic machine and process where particulate material is removed from the surface of an electrostatographic imaging member by at least one blade member having an edge engaging the surface. The blade edge is vibrated at a frequency sufficiently high to substantially reduce the frictional resistance between the blade edge and the imaging surface. The amplitude of the vibrations is controlled to a level which will insure sufficient conformity between the blade edge and the imaging surface so that adequate cleaning can be provided. Preferably the vibrations are carried out at ultrasonic frequencies with an amplitude less than about 0.005 inches.

SUMMARY OF INVENTION

Briefly stated, and in accordance with one aspect of the present invention, there is provided an apparatus for cleaning particles from a surface, comprising: means for cleaning particles from the surface, the cleaning means having two ends, a free end for cleaning the surface and an attached end for positioning the cleaning means in cleaning contact with the surface; and vibrational means, coupled to the cleaning means, on the attached end, to provide vibrational energy to the cleaning means to loosen particles and clean the particles from the surface.

Pursuant to another aspect of the present invention, there is provided a printing machine having means for cleaning particles from a surface, comprising: means for cleaning particles from the surface, the cleaning means having two ends, a free end for cleaning the surface and an attached end for positioning the cleaning means in cleaning contact with the surface; and vibrational means, coupled to the cleaning means, on the attached end, to provide vibrational energy to the cleaning means to loosen particles and clean the particles from the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 7:
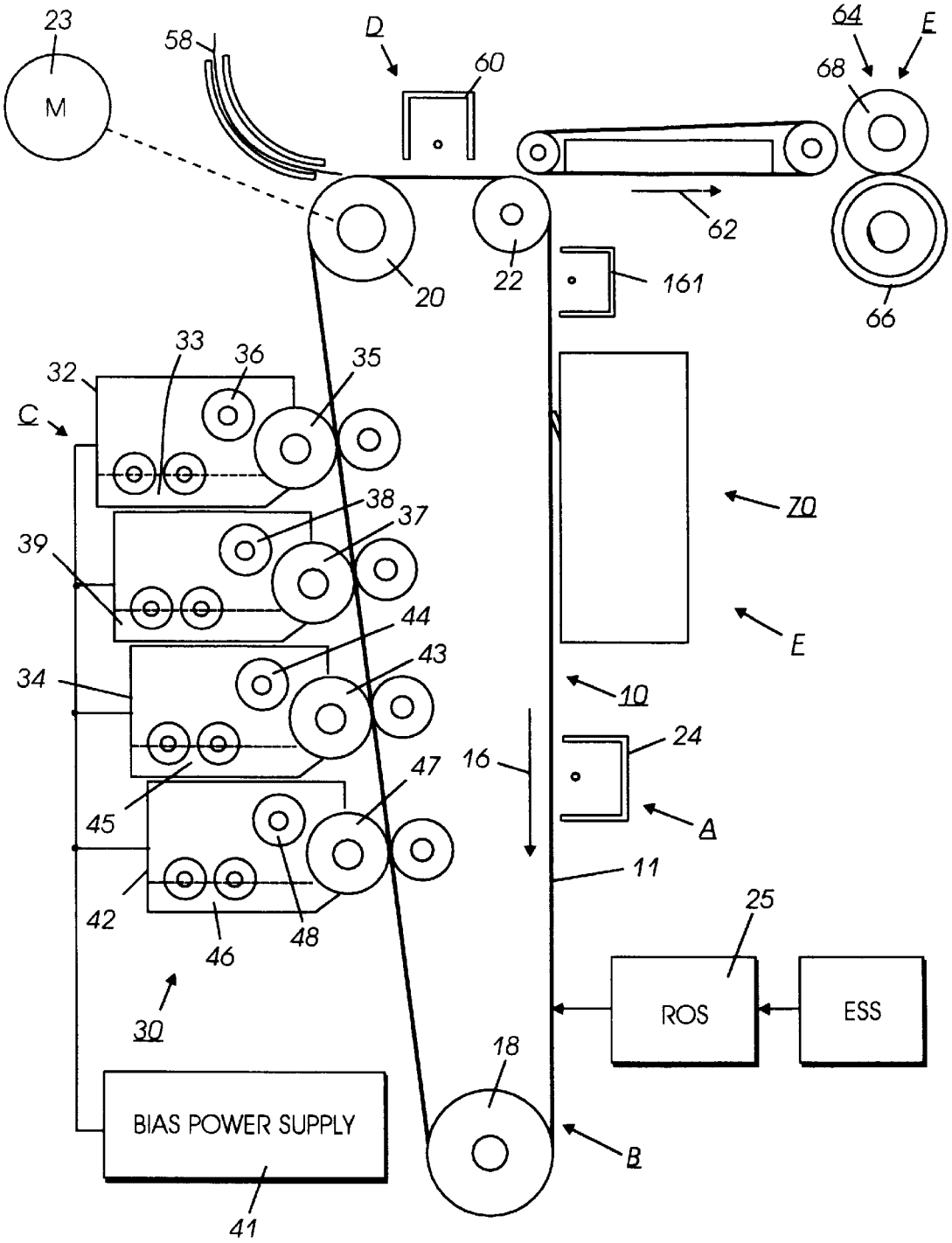
FIG. 7 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 7 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 7, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70. A preclean corotron 161 is located upstream from the cleaning system 70.

Figure 1:
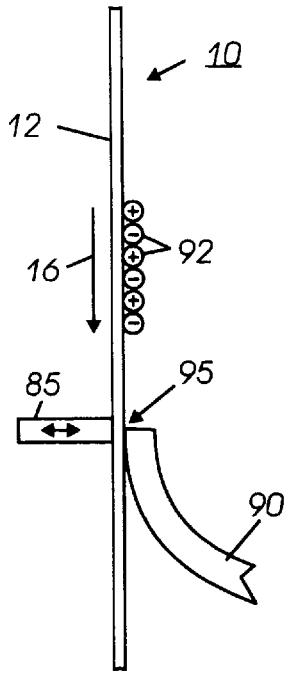
FIG. 1 PRIOR ART
FIG. 1 is the prior art of a UCA vibrating against the back of a photoreceptor.

Reference is now made to FIG. 1 which discloses a prior art ultrasonic device for a cleaning blade. In FIG. 1, the ultrasonic cleaning assist (UCA) device 85 vibrates against the back side 12 of a photoreceptor 10 directly under the cleaning nip 95 to enable the cleaning edge of the blade to vibrate when the blade is cleaning. This creates a low frictional force between the blade 90 and the photoreceptor 10. The UCA loosens toner particles 92 from the photoreceptor surface 11 to assist the cleaning blade 90 in cleaning the toner particles 92 from the photoreceptor 10. However, with this method there are some disadvantages. First, the tip of the ultrasonic device 85 must be located directly under the cleaning edge to operate and to create an "air bearing" effect which reduces the blade friction by about 50%. Second, the ultrasonic device 85 must be located inside the belt module. If the belt module is small and lacks room, this creates a problem. Third, if the blade material is for example too soft, such as a low modulus urethane with a hardness less than 70 Shore A, then the vibration is dissipated in the blade material and the cleaning edge does not vibrate. Fourth, if a high blade force is required to enable the blade to clean, then this force also dampens the vibration of the cleaning edge contacting the photoreceptor.

Figure 2:
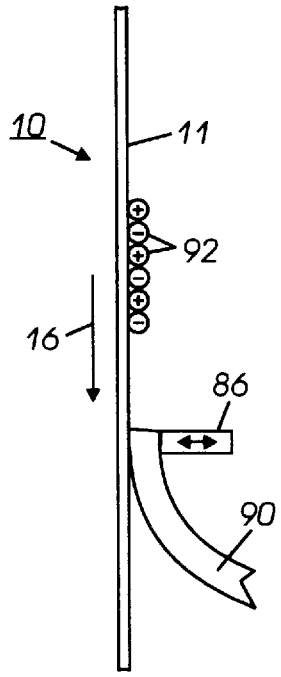
FIG. 2 is an embodiment attaching the UCA to the tip of the cleaning blade.

The present invention desires to improve cleaning by ultrasonically vibrating a cleaning blade with a transducer similar to the application described and shown in FIG. 1. FIG. 2 shows an initial embodiment of the present invention to improve cleaning by attaching the ultrasonic device 86 to the tip of the cleaning blade 90. However, in this embodiment, the softer blade material dampens the ultrasonic energy and cleaning is not enhanced.

Figure 3:
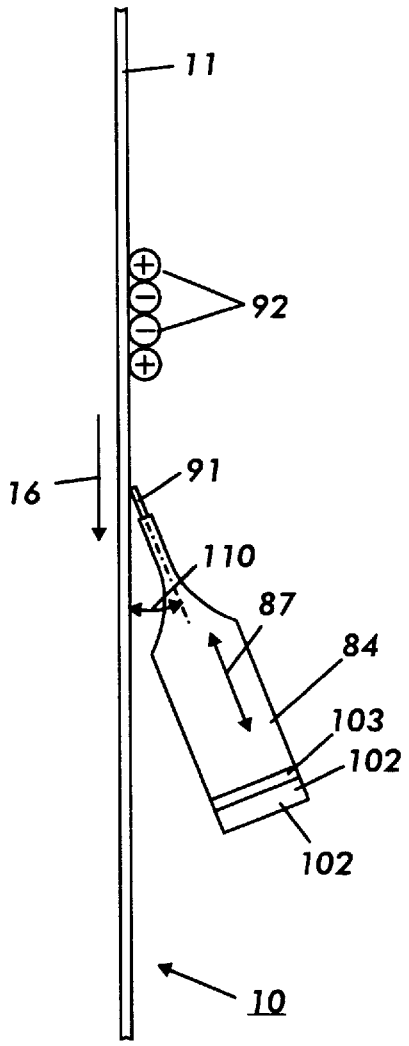
FIG. 3 is the preferred embodiment of the present invention.

Reference is now made to FIG. 3 which shows the preferred embodiment of the present invention. In the present invention, the blade material is attached to the tip of the waveguide 84. The waveguide is attached to the piezoelectric transducer 102 with a bond layer 103 therebetween. This embodiment differs from the prior art of FIG. 1, where the ultrasonic device 85 is placed under the belt 10 to excite the blade edge and loosen toner; and FIG. 2, where the ultrasonic device 86 is attached to the cleaning edge of the blade 90. In the present invention shown in FIG. 3, the cleaning blade 91 material is an extension of the waveguide 84. When the waveguide 84 is driven at its resonant frequency, the largest vibrations are developed at the cleaning edge of the blade. As shown in FIG. 3, the structure of the ultrasonic device is used to apply the blade force. The working angle 110 between the cleaning blade 91 and the photoreceptor 10 will vary from about 5 degrees to about 20 degrees. This angle setting depends on the stiffness of the blade 91.

Experimentation of the preferred embodiment demonstrated that with the ultrasonic device 84 off, the blade 91 cleaned only when a large blade force was applied. However, when the ultrasonic device 84 was turned on (i.e. operational), a much lower blade force was required. The vibrational motion of the ultrasonic device is shown by the arrow 87. The cleaning blade 91 immediately started to remove particles from the photoreceptor 10 with a much lower blade force. During experimentation, a clear difference in the amount of friction present was noticed between when the transducer 102 was on and when the transducer 102 was off. A significant drop in friction between the cleaning blade 91 and the photoreceptor surface 11 occurred when the transducer 102 was on.

Additionally, the reduction in friction was measured for the ultrasonic blade cleaning using a blade frictional fixture to measure the frictional properties of urethane blade materials. These results are shown in TABLE 1 located in the Appendix. These results show that the ultrasonic blade significantly reduces the friction for materials such as steel and plastic. The reduction in the coefficient of friction was greater for the steel blade than for the plastic blade, because of steel's higher modulus of elasticity, hence, greater efficiency in transmitting vibrational energy.

The frictional measurements in TABLE 1 suggest that the harder steel material provides better vibrational energy than the plastic material tested. There is an initial reluctance to the use of a steel blade on a photoreceptor because of the damage a steel cleaning blade can cause to the photoreceptor surface. However, the vibrating steel tip does not make intimate contact with the photoreceptor thereby avoiding damage and/or scratching of the photoreceptor by the steel blade.

In addition to the need for removal of the residual toner particles from the imaging surface of the photoreceptor, additive films also require removal. Soft films composed of for example: ZnSt, $SiO_2$, $TiO_2$, and other toner materials, are located on the imaging surface. These films are approximately one micron thick and cause an increase of the background on a copy. The thickness of these films increase when the additive levels in the toner are increased. Experimental testing of a steel ultrasonic blade, with a 25 gm/cm load, easily cleaned the filmed photoreceptor. Comets and spots often have the same consistency of an additive film and likewise would be removed from the photoreceptor by the ultrasonic blade of the present invention.

Figure 4A:
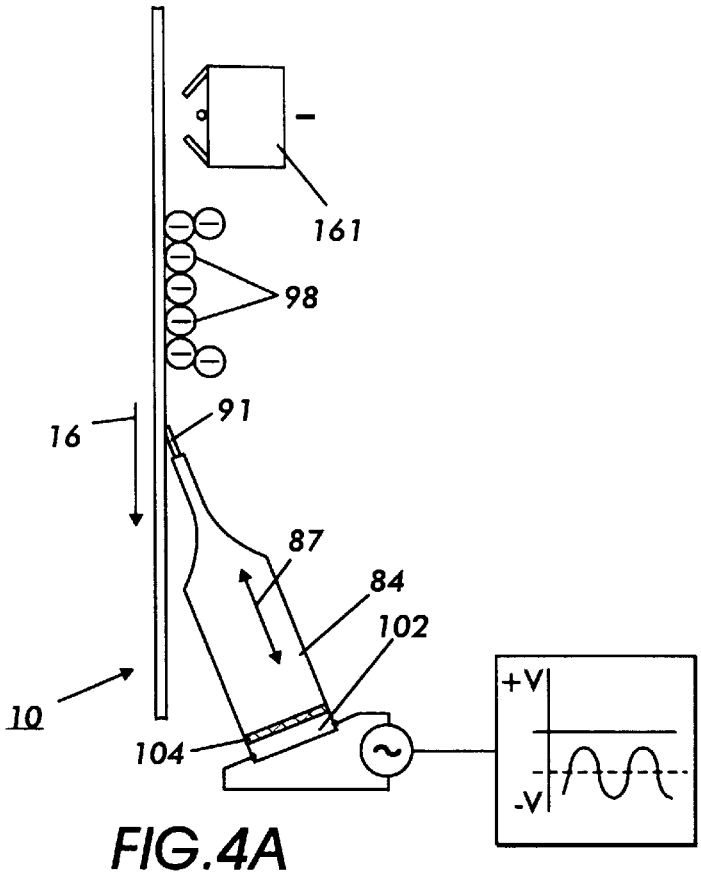
FIG. 4A is an embodiment of the present invention showing an AC driving waveform offset with a negative DC bias to bias the ultrasonic horn tip.
Figure 4B:
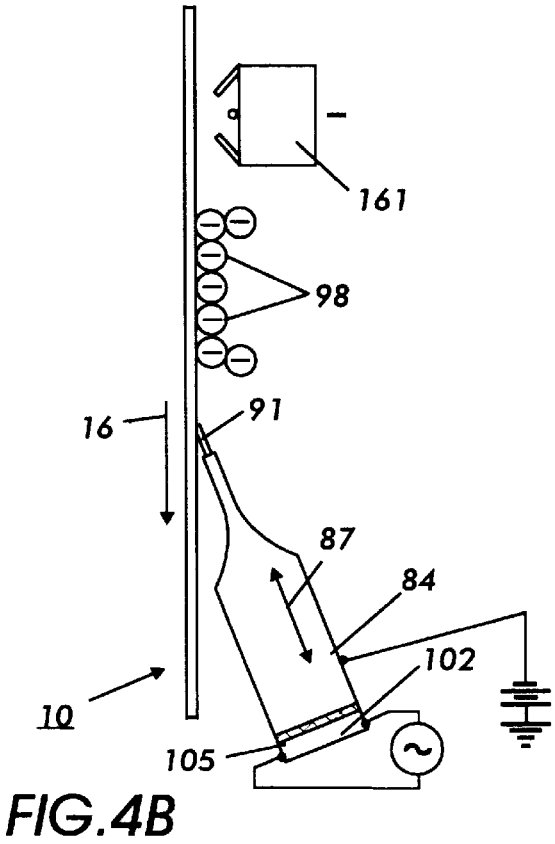
FIG. 4B is an embodiment of the present invention showing the ultrasonic horn or waveguide biased with DC voltage.

A further embodiment of the present invention includes a feature that can be employed to further improve the cleaning performance of the ultrasonic blade cleaner. With a conductive blade material such as steel or conductive plastic, the cleaning blade can be biased. There are different ways to bias the blade. First, as shown in FIG. 4A, the AC signal used to drive the piezoelectric transducer 102 (PZT) is offset (i.e. biased) negatively for negative toner. In this case, there is electrical conductivity between the PZT 102 and the cleaning blade 91. A conductive bond layer 104 is present between the PZT 102 and the waveguide 84. In the second case, as shown in FIG. 4B, the cleaning blade 91 and the waveguide 84 are isolated from the PZT 102 by a non-conductive bond layer 105, so that a negative D.C. bias can be applied to cleaning blade 91 through the waveguide 84. Third, the cleaning blade could be isolated from the waveguide 84 so that the bias could be applied directly to the blade 91. The application of a bias creates a strong electrostatic repulsion between the toner 98 and the blade tip causing the toner to dislodge and be directed away from the photoreceptor and the cleaning edge, and therefore enhance cleaning. With the appropriate bias, this toner 98 can be directed into the waste collection container. Another advantage of biasing the blade occurs in a multi-pass color copier where the blade 91 must be cammed off the photoreceptor 10 during the imaging mode. When the blade 91 is cammed off the photoreceptor 10, a line of toner 98 is left on the photoreceptor 10. This is the residual toner adhering to the photoreceptor just in front of the cleaning edge of the blade 91. This toner is removed from the photoreceptor by the biased blade 91.

When the blade tip velocity approximately equals the waveguide tip velocity, then very little energy is being lost in the blade material. Experimental results of measured tip are shown in TABLE 2 (see APPENDIX) along with the frictional results obtained when the cleaning performance of the blade was tested. Similar to the results shown in TABLE 1, the "harder" (e.g. high modulus) the material, the higher the tip velocity. Experimentation further showed that very little vibrational energy is lost when harder materials are used. The harder materials are also effective in cleaning when the tip velocity is about 500 mm/sec or greater for a device that operates at 60 KHz. However, the standard urethane material (e.g. soft urethane ~70 Shore A) absorbs the vibrational energy, therefore not allowing this energy to transmit to the blade tip. Thus, a urethane material for this application requires a hardness value greater than 85 Shore A.

Figure 5:
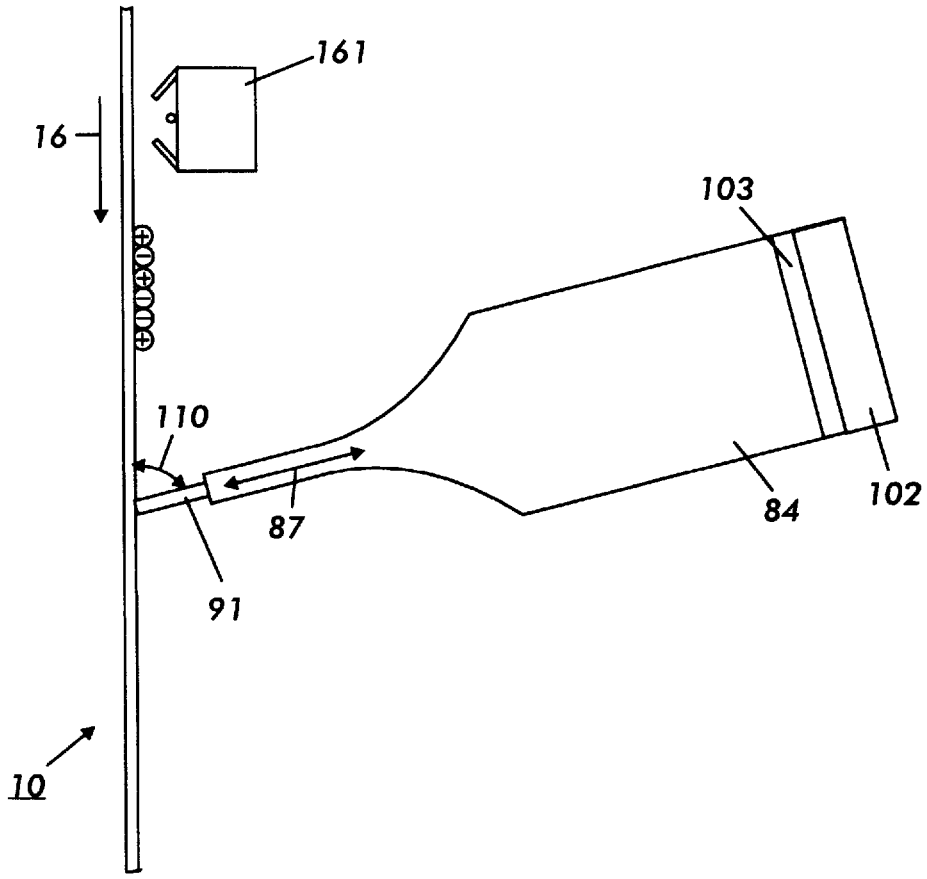
FIG. 5 shows the present invention in the wiping position relative to the photoreceptor.

Various cleaning configurations of the present invention were experimentally tested in the doctoring and wiping mode to demonstrate the effectiveness of the UCA device. Reference is now made to FIG. 5 which shows the UCA device blade in the wiping mode. The working angle 110 is about 70 degrees to about 85 degrees for the cleaning blade 91 relative to the photoreceptor 10. The cleaning ability of the blade 91 is a function of the blade tip velocity. A vibrational component along the photoreceptor creates a standing wave pattern in the toner on the photoreceptor 10. The significance of the standing wave pattern is that it breaks the toner adhesion to the photoreceptor, and keeps the toner in constant agitation until the toner is removed. This effect reduces the toner adhesion and does not allow the toner to adhere back onto the photoreceptor. The distance of the standing wave pattern that extends in front of the blade tip is proportional to the blade tip velocity and amplitude. This gives a qualitative indication of the energy lost in the material, and whether or not the cleaning edge is vibrating. For example, with a soft urethane (e.g. ~70 Shore A), the vibrational energy is dissipated in the urethane so the cleaning edge vibration is low and there is no standing wave pattern. Therefore, the friction and force required to make the blade clean is high. The cleaning assessment for this configuration is summarized in TABLE 3 (see APPENDIX).

Figure 6:
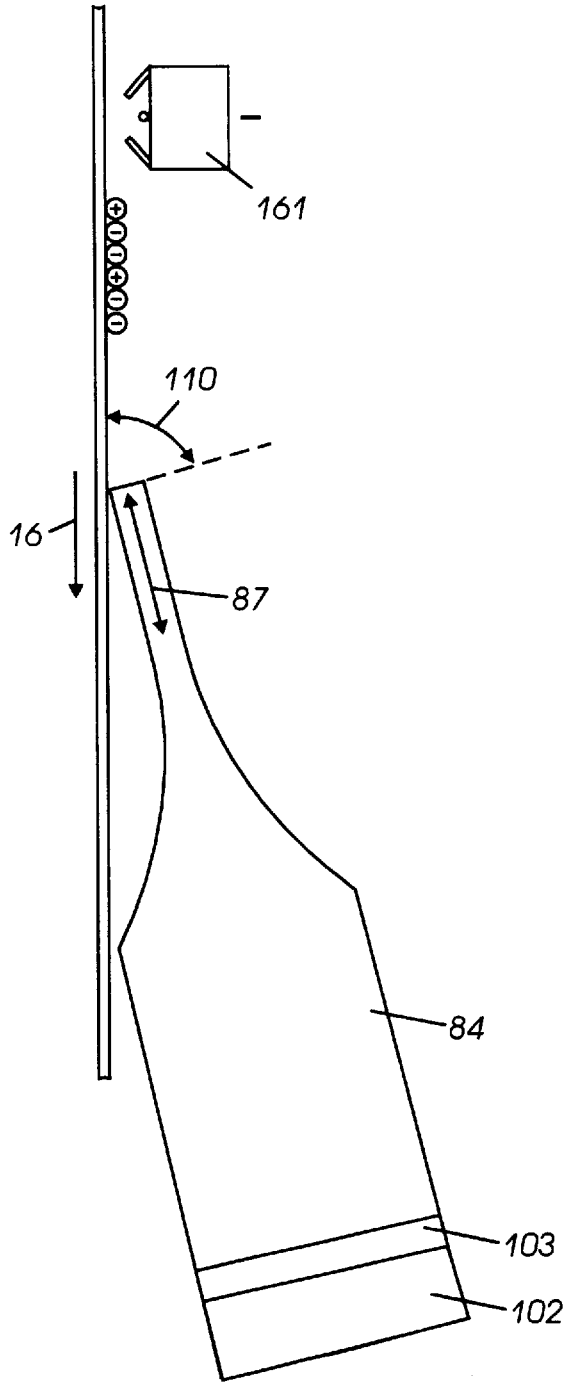
FIG. 6 shows the present invention in the doctoring mode relative to the photoceptor.

FIG. 6 shows the UCA itself cleaning toner off the photoreceptor in the doctor mode. A sharp square tip is required at the ultrasonic horn to create an effective cleaning blade edge. A sharp edge prevents streaking during cleaning while providing results similar to those summarized in TABLE 3. It is noted that a cleaning blade inserted into the ultrasonic horn, in the doctoring mode, provides effective cleaning of the photoreceptor. The radius of curvature of the cleaning edge should be less than 1 mi. The preferred radius of curvature for the sharp cleaning edge should be less than the toner diameter. The ultrasonic horn with a sharp cleaning edge performs more efficiently than an ultrasonic horn with a blade because there is no coupling material (bond layer) between the horn and the blade.

The experimental results successfully show that the blade material can be attached to the UCA horn tip, or the horn tip itself can be used as a cleaning blade. Effective cleaning was demonstrated in each case, and a significant drop in friction was found with the UCA.

In recapitulation, the present invention utilizes an ultrasonic transducer attached to a cleaning blade (or other cleaning device) to remove particles from the imaging surface of a photoreceptor. The vibrational energy of the transducer is concentrated at the blade tip that contacts the imaging surface for better cleaning. The blade tip velocity of the present invention is greater for harder materials and thus, harder blade materials are preferred because softer materials absorb the vibrational energy. The present invention also reduces the blade force required for cleaning due to the ultrasonic assist. The present invention also enables cleaning of the imaging surface with a sharp edge of the horn tip without the use of a cleaning blade. Another embodiment of the present invention, biases the cleaning blade or ultrasonic horn to repel particles from the cleaning edge causing the toner particles to repel away from the cleaning edge for enhanced cleaning.

It is, therefore, apparent that there has been provided in accordance with the present invention, an ultrasonic assist for blade cleaning that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

TABLE 1

APPENDIX
Frictional Measurements of Blade Materials with the Transducer On and Off

| | Coefficient of Friction, $\mu$ | | |
|---|---|---|---|
| Blade Material | With Transducer ON | With Transducer OFF | % Improvement in $\mu$ using Ultrasonics |
| Steel 2.5 mils thick | 2.3 | 6.4 | 64 |
| | 4.9 | 8.3 | 41 |
| | 3.0 | 8.3 | 64 |
| | | | <Avg. ≈ 56%> |
| Plastic: | 1.9 | 4.5 | 59 |
| PEEK 10 mils thick | 6.0 | 8.6 | 30 |
| | 5.7 | 8.3 | 31 |
| | | | <Avg. 40%> |

TABLE 2

Tip Velocity of UCA with Different Materials

| Material | Tip Velocity mm/sec | Blade Friction Response Measured from Low to High |
|---|---|---|
| Steel | 1350 | Low |
| Hard Plastic PEEK | 813 | Low |
| Hard Urethane 96 SHORE A | 500 | Medium |
| Hard Urethane 70 SHORE A | 200 | High |

TABLE 3

Cleaning Performance of Blade Materials With and Without the UCA

| | Cleaning Performance | | | |
|---|---|---|---|---|
| Blade Material | With UCA | Without UCA | Friction | Standing Wave Pattern |
| Steel | Excellent | Cleaned OK, but higher force required | Low | Very pronounced standing wave that extends out in front of the blade approximately 50 mm |
| Plastic | Good | Cleaned Ok, but higher force required | Greater than steel | less pronounced than steel, standing wave pattern is about 25 mm |
| Hard Urethane | Good | Cleaned OK, but higher force required than plastic | Much higher than plastic and steel | Small standing wave pattern just in front of the blade approximately 15 mm |
| Soft Urethane | Good, but high force | Cleaned Ok, but much higher force required than plastic | much, much higher than the materials above which means that the cleaning edge is not vibrating | No wave pattern in front of the blade |

It is claimed:

1. An apparatus for cleaning particles from a surface, comprising:

an ultrasonic horn having two ends including a first end and a second end, the second end being opposite the first end and having a horn tip, said horn tip having an integral sharp cleaning edge for cleaning the surface and;

a piezoelectric element being adjacently attached to said ultrasonic horn on the first end of said ultrasonic horn for vibrating said horn tip and said integral sharp cleaning edge to loosen particles and clean the particles from the surface.

2. An apparatus as recited in claim 1, wherein said sharp edge is biased in a manner to repel the particles away from said sharp edge separating the particles from the surface for ease of cleaning by said sharp edge.

3. An apparatus as recited in claim 1, wherein said ultrasonic horn comprises a material selected from the group consisting of urethane, plastic and steel.

4. An apparatus as recited in claim 3, wherein said material comprises a hardness value greater than about 85 Shore A.

5. An apparatus for cleaning particles from a surface, comprising:

a cleaning blade, said cleaning blade having two ends, a free end for cleaning the surface and an attached end for positioning said cleaning blade in cleaning contact with the surface;

an ultrasonic horn coupled to said cleaning blade, having two ends including a first end and a second end, the second end being opposite the first end and having a horn tip coupled to said cleaning blade on the attached end, and;

a piezoelectric element being adjacently attached to said ultrasonic horn on the first end and the second end of said ultrasonic horn having a horn tip for vibrating said horn tip and said cleaning blade to loosen particles and clean the particles from the surface.

6. An apparatus as recited in claim 5, wherein said cleaning blade is biased in a manner to repel the particles away from said cleaning blade separating the particles from the surface for ease of cleaning by said cleaning blade.

7. An apparatus as recited in claim 5, wherein said cleaning blade comprises a material consisting of urethane, plastic and steel.

8. An apparatus as recited in claim 7, wherein the material of urethane comprises a hardness value greater than about 85 Shore A.

9. A printing machine having means for cleaning particles from a surface, comprising:

a sharp cleaning edge, said sharp cleaning edge having two ends, a free sharp end for cleaning the surface and an attached end for positioning said sharp cleaning edge in cleaning contact with the surface; and vibrational means, efficiently coupled to said sharp cleaning edge, on the attached end, to provide vibrational energy in a motion substantially orthogonal to said sharp cleaning edge to loosen particles and clean the particles from the surface.

10. A printing machine as recited in claim 9, wherein said sharp cleaning edge comprises a blade.

11. A printing machine as recited in claim 10, wherein said vibrational means holds said blade at a working angle relative to the surface to remove particles therefrom.

12. A printing machine as recited in claim 11, wherein said blade comprises:

a blade body having two ends, a first blade body end being coupled to said vibrational means, a second blade body end located along the length of said blade body opposite the first blade body end; and a blade tip, said blade tip located at the second blade body end, said blade tip having vibrational contact with the surface to loosen and remove particles from the surface.

13. A printing machine as recited in claim 12, wherein said vibrational means provides vibrational energy to said blade.

14. A printing machine as recited in claim 13, wherein the vibrational energy to said blade being concentrated at said blade tip.

15. A printing machine as recited in claim 14, wherein said blade is biased in a manner to repel the particles away from said blade tip separating the particles from the surface for ease of cleaning by said blade.

16. A printing machine as recited in claim 10, wherein said blade comprises a material consisting of urethane, plastic and steel.

17. A printing machine as recited in claim 16, wherein the material of urethane comprises a hardness value greater than 85 Shore A.

18. A printing machine as recited in claim 9, wherein said vibrational means comprises:

an ultrasonic horn having two ends including a first end and a second end, the second end being opposite the first end; and a piezoelectric element being adjacently attached to said ultrasonic horn on the first end and the second end of said ultrasonic horn having a horn tip for cleaning.

19. A printing machine as recited in claim 18, wherein said sharp cleaning edge is integral to said horn tip.

20. A printing machine as recited in claim 19, wherein said sharp cleaning edge integral to said horn tip being positioned for frictional contact with the surface to remove particles therefrom.

21. A printing machine as recited in claim 20, wherein said sharp edge is biased in a manner to repel the particles away from said sharp edge separating the particles from the surface for ease of cleaning by said sharp edge.

* * * * *